US006598868B2

(12) United States Patent
Gortner

(10) Patent No.: US 6,598,868 B2
(45) Date of Patent: Jul. 29, 2003

(54) CLAMP MECHANISM

(76) Inventor: Kenneth Gortner, 736 Carhart St., Fullerton, CA (US) 92833

( * ) Notice: Subject to any disclaimer, the term of this patent is extended or adjusted under 35 U.S.C. 154(b) by 0 days.

(21) Appl. No.: 09/876,534

(22) Filed: Jun. 6, 2001

(65) Prior Publication Data

US 2002/0171190 A1 Nov. 21, 2002

Related U.S. Application Data

(60) Provisional application No. 60/209,619, filed on Jun. 6, 2000, and provisional application No. 60/252,155, filed on Nov. 22, 2000.

(51) Int. Cl.[7] ..... B25B 1/06

(52) U.S. Cl. ..... 269/219; 269/182; 269/221

(58) Field of Search ..... 269/219, 41, 283, 269/53, 54–54.3, 244, 265, 271, 279, 280; 403/362; 29/275, 270

(56) References Cited

U.S. PATENT DOCUMENTS 174,838 A * 3/1876 Naumann ..... 269/219
178,022 A * 5/1876 Naumann ..... 269/219
179,942 A * 7/1876 Naumann ..... 269/219
1,428,608 A * 9/1922 Parker ..... 269/219
2,351,178 A * 6/1944 Zimmerman ..... 269/219
5,326,076 A * 7/1994 Sorensen et al. ..... 269/219
5,335,898 A * 8/1994 Johnson ..... 269/41
5,370,157 A * 12/1994 Oertli ..... 403/362

* cited by examiner

*Primary Examiner*—Lee D. Wilson
(74) *Attorney, Agent, or Firm*—Frank L. Zugelter

(57) ABSTRACT

A device (20) having a pair of jaws (22, 23) cooperating with a pair of threaded rods (24, 25) and which displace equally from a midpoint (36) of device (20) along threaded rods (24, 25). A spirally-wound rod (40) with sets (41, 42) of keyways rides in sets (50, 51) of keys positioned in jaws (22, 23). A center plate (44) for the rods (24, 25, 40) maintains them at a midpoint (36) for device (20). Sliding assemblies (60, 94) lock and unlock barrel nuts (71, etc.) in the jaws (22, 23) from threaded rods (24, 25). Different senses of threads for threaded rods (24, 25) extend to each side of rod (40). In another embodiment, a push handle (116) directly actuates the 'quarter-turn' threads in bores (122) of barrel nuts (115) into and out of engagement with threaded rods (121).

32 Claims, 13 Drawing Sheets

CLAMP MECHANISM

This invention is related to but not limited to provisional applications U.S. Ser. Nos. 60/209,619, filed Jun. 6, 2000 and 60/252,155, filed Nov. 22, 2000 in the U.S. Patent and Trademark Office.

TECHNICAL FIELD

This invention is directed to a clamp mechanism for clamping parts together, and particularly relates to a unique clamp mechanism.

BACKGROUND TO THE INVENTION

The disclosures of U.S. Pat. Nos. 169,027; 179,942; 305,989; 368,278; 810,543; 924,122; 996,244; 3,220,721; 4,693,656; 5,326,076; 5,898,974 do not anticipate or suggest the inventive concept disclosed in this invention.

SUMMARY

This invention is directed to a clamp mechanism having clamping jaws that lock on and unlock from threaded rods by actuation of barrel nut assemblies within the jaws and which barrel nuts are actuated by sliding assemblies securely mounted on the jaws. The jaws' clamp pieces, such as wood, to be fastened together such as by glue, or clamp other pieces for other purposes. In one embodiment, a pair of sliding assemblies are securely mounted to corresponding jaws moveable to-and-fro along a pair of handled-threaded rods that rotate in conventional fashion to incrementally displace the jaws along the threaded rods to fasten or clamp them against the pieces or to freely displace the jaws in opening and closing them in preparation of loosely grasping the pieces after which rotation of the threaded rods produces the final and firm clamped mode for the pieces.

Each sliding assembly includes a bar member having a pair of inclined slotted ramps, bolts with washers, spacers, and boltheads, the bolts projecting through the ramp's slots and secured to 'quarter-turn' barrel nuts in the jaw, the washer maintaining the boltheads on their ramps. As the assembly slides from one position to another, the bolts displace along the ramp perpendicularly to the plane of its corresponding jaw, and thereby raise and lower the corresponding barrel nuts in each jaw. In the raised or upper position on the ramps for the boltheads, the barrel nuts' "quarter-turns" of threads engage the threads of their corresponding rods thus locking the jaw at that point of the rods' threads, and as to both jaws in the mechanism. In the lower or bottom position in each jaw for the boltheads on the ramps, the threaded rod is free of the 'quarter-turn' of threads in the barrel nut and thus the jaw displaces freely, not incrementally, and also as to both jaws in the mechanism.

With a sliding assembly securely mounted to each of a pair of jaws in a clamp mechanism, the jaws are manually operable at points along their pair of threaded rods by applying the thumbs of one's hands to the assemblies while their fingers seat in or grip walls of recesses formed in the exterior sides of the assembled jaws on the threaded rods. The thumbs slide or maneuver the assemblies from their one position to the other, locking and unlocking the jaws at points along the lengths of the threaded rods.

A third rod and a plate member are utilized to maintain equality of opening and closing of the jaws from one another along their threaded rods. The plate member is mounted mid-way of the third rod and threaded rods. The third rod is generally aligned and extends in the same directions with the pair of threaded rods but offset from the plane through the jaws in which the threaded rods are disposed. The third rod includes two (2) sets of spirally-wound keyways, one set for each rod's sense of threads to each side of the plate member. The keyways extend along its length about its circumference and cooperate with corresponding keys fixed in corresponding tubular members securely anchored in cylindrical fittings fitted to corresponding jaws as the latter displace away or toward the plate member. A nut secured to each end of the third rod prevents the jaws from exiting the open ends of the threaded rods as the jaws approach their extreme opened positions on the threaded rods.

The plate member is provided with geometrical holes through which all three rods extend, and includes configurations in the holes by which the span between the threaded rods and to and from the third rod can change by reason of the span's distance changing when the jaws are angularly displaced in the general plane of the rods on their rotatable barrel nuts from a perpendicular condition with the rods, in the operation of the invention.

An alternate embodiment provides for a sliding assembly securely mounted on each of the jaws, the assembly being in the form of a rail having depending sides slidable within slideways formed in the jaw, a pair of barrel nuts with 'quarter-turn' threads in their bores that are disposed within the spacing between the slideways, and a pin fixed to its corresponding barrel nut, the pin held in fixed hollowed-out locations or openings in the jaw exteriorly of its slideways. Congruous slots are formed in the depending sides of the rail, adapted to ride on the pin that projects through such slots into its hollowed-out locations or openings, as each slides between clamping and unclamping positions of the jaw on its threaded rod. The congruous slots include inclinations so that as they ride on the pin as the assembly moves to-and-fro on its jaw, the pin raises and lowers its corresponding 'quarter-turn' barrel nut within the jaw, this in turn causing the threads of corresponding threaded rods to engage and disengage the 'quarter-turn' threads in the barrel nut.

Another embodiment of the invention provides for a handle extending along each jaw and which is fixed directly to each of a pair of 'quarter-turn' barrel nuts incorporated within each jaw, while utilizing a spring at the bottom of a bore for each barrel nut to bias its 'quarter-turn' threads into engagement with the threads of the threaded rods. As palm (of a hand) pressure is applied directly to each jaw's handle, dis-engagement in the jaw of its threaded rods from the 'quarter-turn' threads occurs, thereby freeing the jaws for displacement along the length of the threaded rods.

Gripping recesses in each jaw are provided to grasp them by one's fingers as the jaws displace along their threaded rods, while thumb grips or positions on the sliding assemblies provide the source of manual force to advance and to retract the sliding assemblies mounted on the jaws into and out of engagement modes with the threaded rods of the clamp mechanism. Other conical-like recesses radiating from the rotatable barrel nuts in both jaws accommodate the angular or swinging movement of the jaws should it be necessary to clamp a piece or pieces which include surfaces not parallel to the jaws clamping walls.

An object of this invention is to provide a unique advancement in clamp mechanisms.

A further object of this invention is to provide a novel sliding assembly for a clamp mechanism by which its jaws lock and from unlocked in their engagement with its threaded rods.

Another object of this invention is to provide for equality of movement in the opening and closing between a pair of jaws on their threaded rods of the device or mechanism.

Yet another object of this invention is to provide a simplified assembly of a clamp mechanism by a push handle connected in a simple fashion to barrel nuts in it.

A still further object of this invention is to provide for an efficient operation of a clamping device or mechanism.

These and other objects and advantages will become more apparent by a complete and full reading of the following description, the appended claims thereto, and the accompanying drawing comprising thirteen (13) sheets of twenty-five (25) FIGURES.

BEST MODE OF CARRYING OUT THE INVENTION

Figure 1:
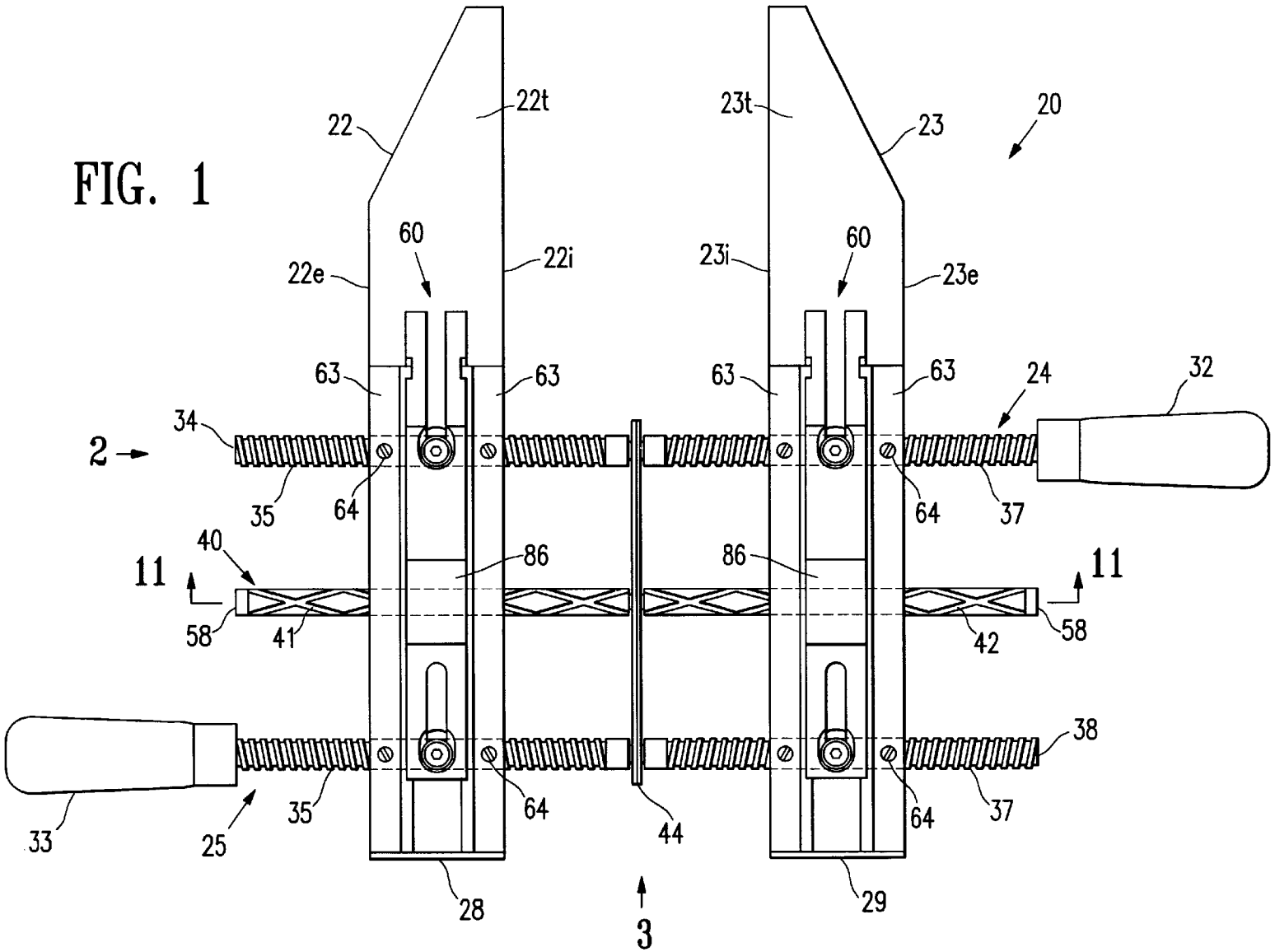
FIG. 1 is a top or front view of the clamp mechanism, showing the invention's sliding assembly in a position on its jaw at which there is engagement of the jaws' threaded rods with the 'quarter-turn' threads of their barrel nuts.
Figure 2:
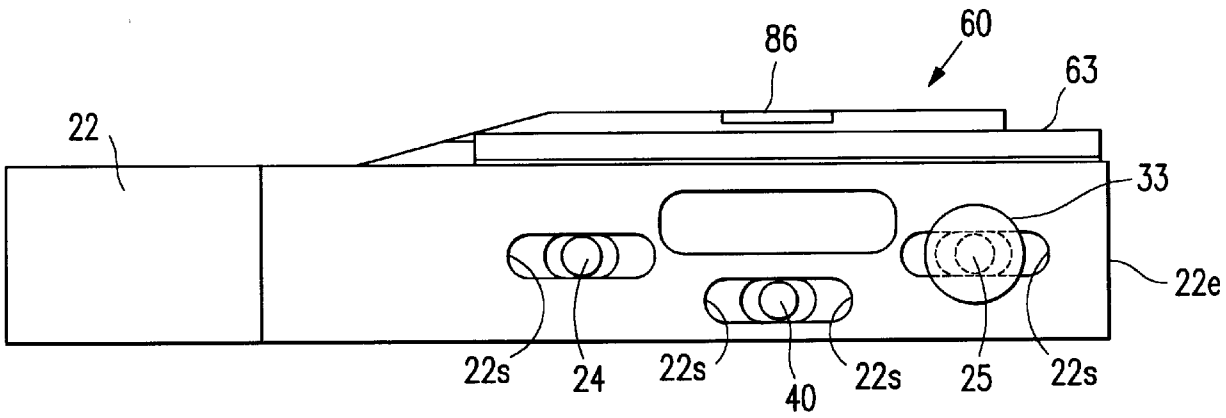
FIG. 2 is a view of the clamp mechanism taken in the direction of the arrow 2 of FIG. 1.
Figure 3:
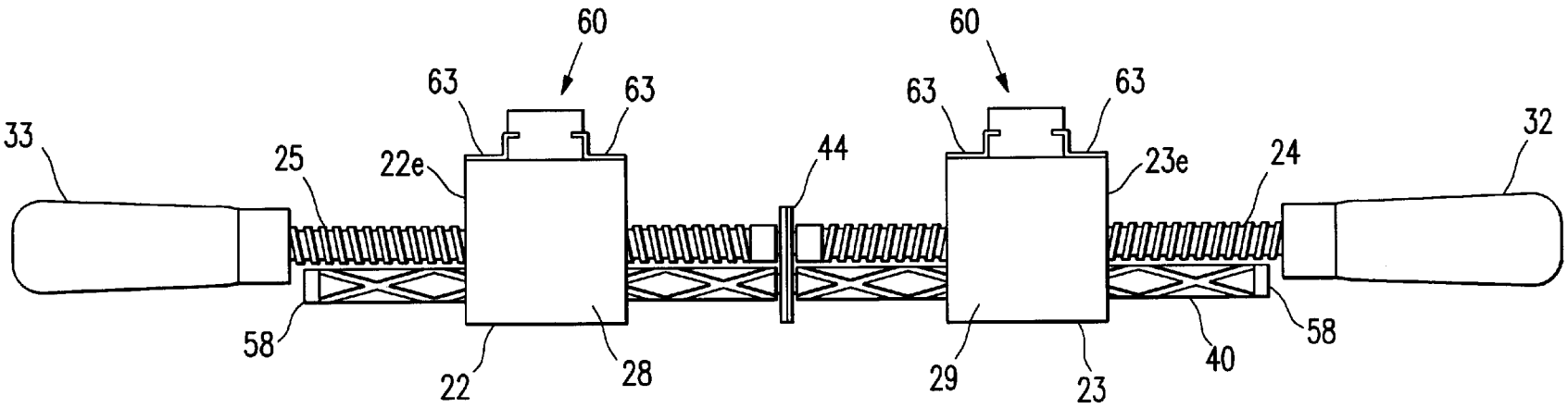
FIG. 3 is a view of the rear end of the clamp mechanism taken in the direction of the arrow 3 in FIG. 1.
Figure 4:
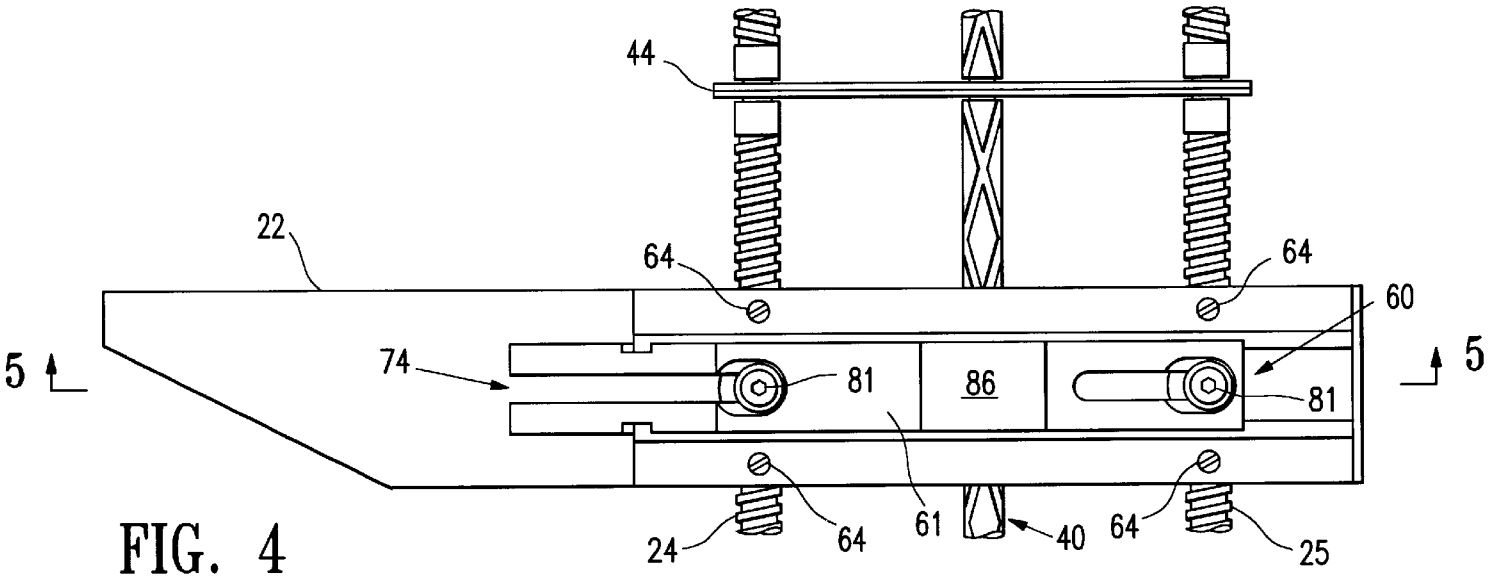
FIG. 4 is a fragmentary enlarged top or front view of one of the jaws of FIG. 1.
Figure 5:
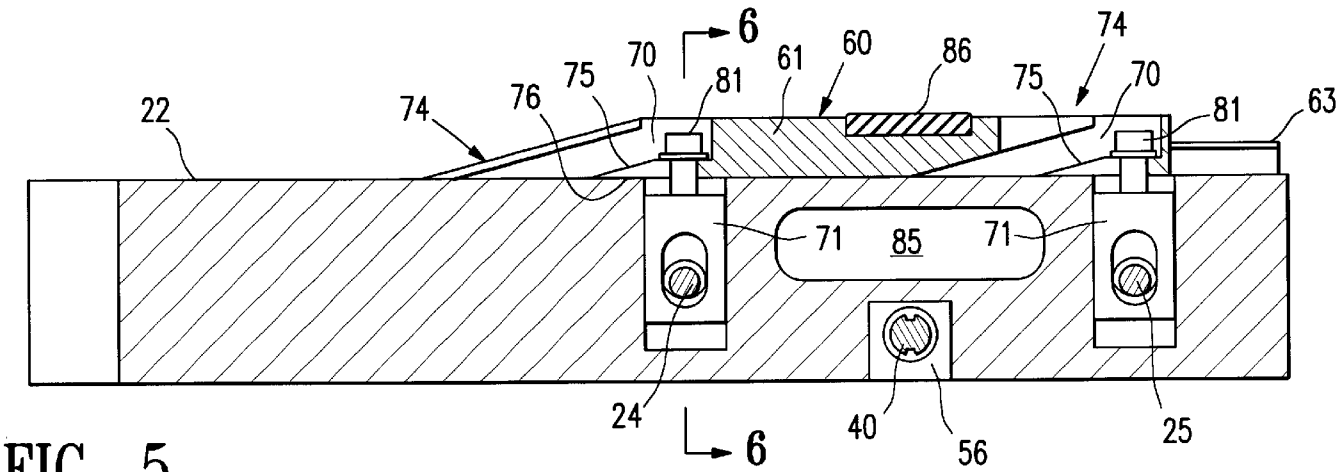
FIG. 5 is a view taken along line 5—5 of FIG. 4, showing the sliding assembly of FIG. 1 in a position on one of the jaws at which there is engagement of the jaw's threaded rods with the 'quarter-turn' threads of its barrel nuts.

Referring now to the drawing in which reference characters correspond to like numerals hereinafter, FIG. 1 illustrates an embodiment of this invention of a clamp mechanism 20 in its clamped mode about threaded rods. Clamp mechanism 20 is provided with a pair of clamping jaws 22, 23, each arranged for movement to and away from each other in conventional fashion for clamping components or elements together, say, for example, such as wood, for fastening together by glue. Each of a pair of elongated threaded rods or spindles 24, 25 runs through jaws 22, 23, also in conventional fashion. Rods 24, 25 are spaced along the lengths of jaws 22, 23 from one another, each at generally the same displacement from its corresponding jaw's rear wall 28, 29, as the other. Handles 32, 33 are secured to the opposite ends of rods 24, 25, respectively, for manual rotation in the operation of the invention.

Figure 6:
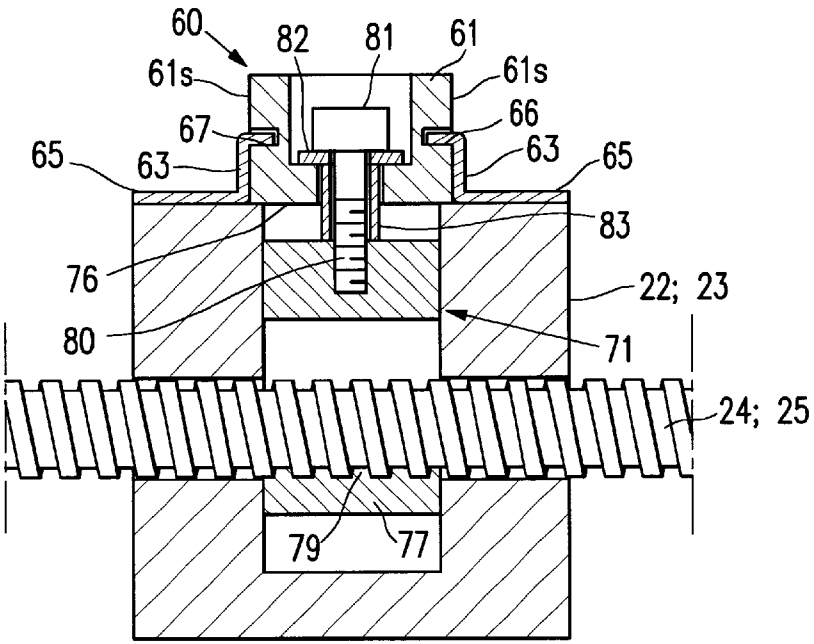
FIG. 6 is a view taken along line 6—6 of FIG. 5, showing engagement of the 'quarter-turn' threads in a barrel nut with a threaded rod's threads.

Rod 24 is threaded from its open end 34 in a first sense 35 to a mid-point 36, FIG. 6, of clamp mechanism 20, and is threaded in a second sense 37 from its handle 32 to mid-point 36 of clamp mechanism 20. However, rod 25 is threaded in the first sense 35 from its handle 33 to the mid-point 36 while being threaded in the second sense 37 from its open end 38 to the mid-point 36. Thus, the same thread sense 35 on both rods 24, 25 are positioned to the same side of mid-point 36 in the assembly of rods 24, 25 to jaws 22, 23, respectively, and the same thread sense 37 on both rods 24, 25 are positioned to the same side of mid-point 36 in the assembly of rods 24, 25 to jaws 22, 23, although the handles 32, 33 of the rods are on ends opposite open ends 34, 38 of their respective rods.

A third threaded rod 40, FIG. 1, is introduced into clamp mechanism 20, running through both jaws 22, 23 in the same directions and in general alignment with rods 24, 25, and disposed between the rods' span, however, offset, FIGS. 2, 3, 5, 9, from the plane through which rods 24, 25 extends. Rod 40 includes sets 41, 42 of spirally-wound keyways, one set operable only to its side of a centrally-positioned rigid or plate member 44 at mid-point 36, although both sets are illustrated as extending throughout the length of rod 40. The keyways of these sets 41, 42 cooperate with keys provided in jaws 22, 23, more fully described hereinafter. The length of rod 40, to each side of plate member 44, is sufficiently long so that in the operation of the invention, jaws 22, 23 can be opened to the widest possible interval between themselves.

Figure 13:
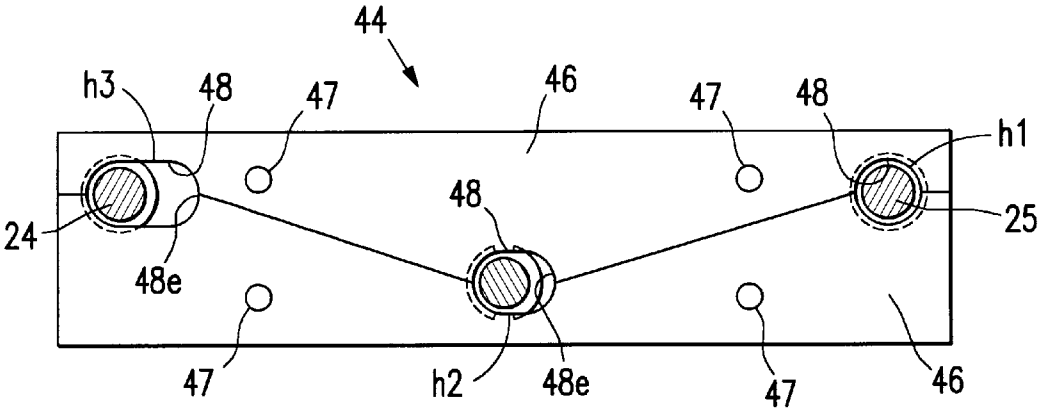
FIG. 13 is a view taken on line 13—13 of FIG. 11.
Figure 14:
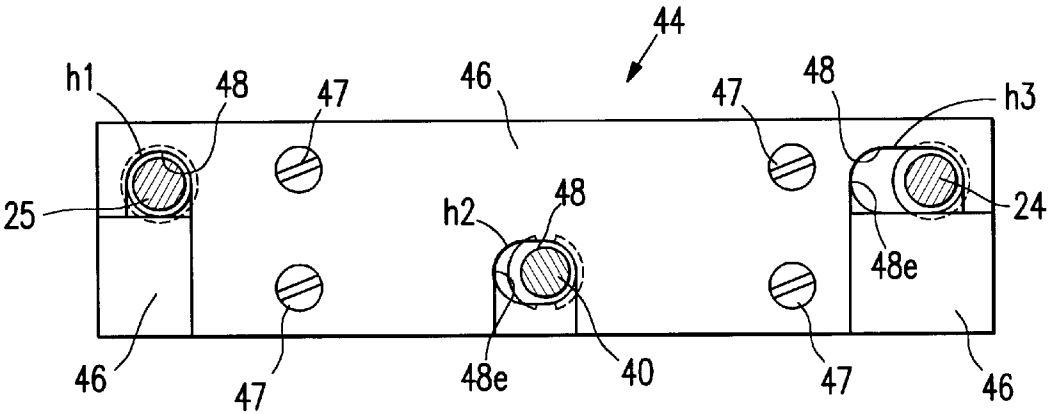
FIG. 14 is a view taken on line 14—14 of FIG. 11.

Plate member 44, FIGS. 1,3,8, 11, extends across the span or distance between spaced rods 24, 25, and rod 40, and in this illustrated embodiment as an assembly of thin flat metal pieces 46, FIGS. 13, 14, put together and held together by screws 47 in its assembly. Pieces 46 are configured with rims 48 so that when assembled together to form plate member 44, holes h1, h2, h3, are formed to circumscribe annular, oval-like, or straight rims 48 50 that upon the flat abutment of pieces 46 one to another the rims 48 form functional holes h1, h2, h3 by which plate member 44 is mounted to and retained at midpoint 36 by a reduction, FIGS. 13, 14, 15, in at least one linear dimension over the diameter of the rods 24, 25, 40, and thereafter assembled plate member 40 remains situated at the mid-point 36 of these rods in the operation of the invention. Hole hi, circumscribing rod 25, is circular in nature, however, holes h2 and h3 are laterally elongated, as illustrated at 48*e* in FIGS. 13, 14, to provide for adequate angular or swinging movement for jaws 22, 23 in their free mode of movement about and along threaded rods 22, 23, in order to grip differently geometrically configured pieces for fastening in the operation of the invention.

Figure 12B:
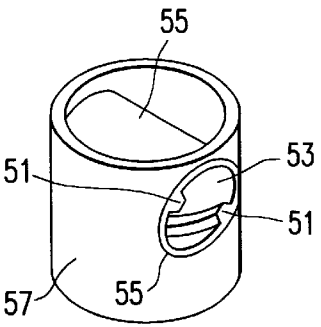
FIGS. 12A and 12B are perspective views of cylindrical fittings [within a jaw] within which fixed tubular bores with keys are formed.
Figure 12A:
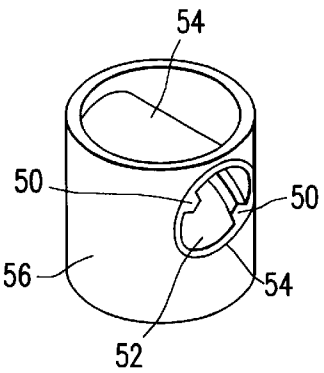
Figure 11:
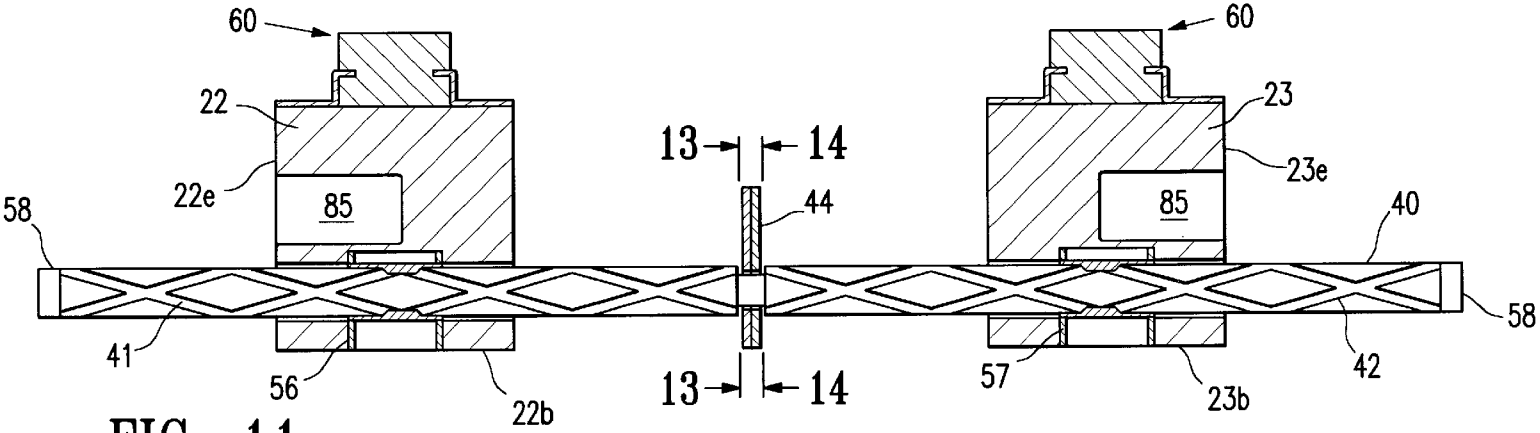
FIG. 11 is a diagrammatic cross-sectional view taken on line 11—11 of FIG. 1.

In order for spirally-wound rod 40 to function by its turning in the operation of clamp mechanism 20, as illustrated in FIGS. 11, 12A and 12B, each of a set 50, 51 of keys is formed on the interior walls 52, 53, respectively, in bores of open-ended tubular members 54, 55, respectively, suitably cross-wise secured in their cylindrical fittings 56, 57, respectively, fixed, such as by a press fit, within their corresponding jaws 22, 23. Cylindrical fittings 56, 57 are incorporated into their respective jaws through their bottom walls 22*b*, 23*b*, as illustrated in FIG. 11. Key set 50 is aligned with and cooperates with the keyway set 41 on spirally-wound rod 40, to the left of mid point 36 as seen in FIG. 1, and key set 51 is aligned with and cooperates with the keyway set 42 on spirally-wound rod 40, to the right of mid point 36 as seen in FIG. 1, and as the jaws 22, 23 displace equally in their opening and closing to and from midpoint 36 in the operation of the invention, rod 49 turns as its keyways pass by its keys fixed in the jaws 22, 23. A nut 58 on each end of rod 40 prevents exiting of jaws 22, 23 from clamp mechanism 20.

A sliding assembly 60, FIGS. 1, 2, 3, 4, 5, 8, 9 is mounted atop each jaw 22, 23 for locking and unlocking them at particular points along the threads of rods 24, 25, the jaws being equally displaced in their movements to and from center plate 44 in each instance in the opening and closing of the jaws, however, still capable of inclination towards or away in their angular movement from one another on the threaded rods at a particular point of locking or unlocking along the length of the threaded rods. A bar 61 is slidably mounted in its place on the topside 22*t*, 23*t* of each jaw 22, 23, respectively, between a pair of rails 62 formed in metal flanged members 63 secured by screws 64 through its one flange 65 to its corresponding topside 22*t*, 23*t* while its other flange 66 extends into grooves 67 in corresponding sidewalls 61*s* of bar 61. A cavity 70 is formed within the depth of each bar 61, in alignment with a pair of barrel nuts 71, FIGS. 6, 7, each in their own positions within its own corresponding jaw 22, 23 and through which pair of barrel nuts 71 the threaded rods 24, 25 correspondingly extend. Each cavity 70, FIGS. 4, 5, includes, in the same direction, towards the rear walls 28, 29 of their corresponding jaws 22, 23, a slotted ramp 74 having shoulders 75 extending in an inclined manner from its base 76 upwardly within the interior of its bar 61, ending in an enlarged closed circle at the top of ramp 74.

Figure 7:
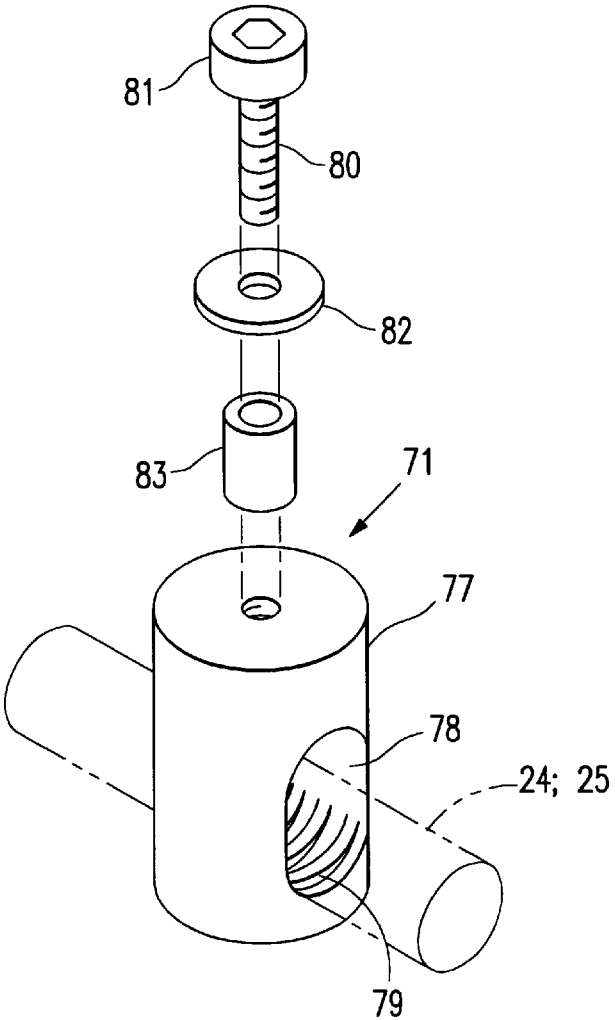
FIG. 7 is a perspective fragmentary exploded diagrammatic view of the 'quarter-turn' barrel nut illustrated in its raised position in FIG. 6 and in which it cooperates with threads of a cooperating threaded rod.

Each barrel nut 71, FIG. 7, is formed in the shape of a cylinder 77 including a body formation forming a vertically-oriented elongated bore 78 of a greater dimension than the diameter of the threaded rods 23, 24 which extend through each bore 78 in assembly of clamp mechanism 20. Bore 78 includes in the proximity to its lowest point a 'quarter-turn' or a portion 79 of threads which duplicate the sense of the corresponding threads of rods 24, 25, FIG. 6 (although FIG. 6, as illustration only, shows one or either sense of threads). A bolt 80 with its head 81 is secured to the top of each barrel nut 71, and a washer 82 and spacer 83 are mounted in such securement to its stem. In assembly, FIG. 6, as a means for connecting sliding assembly 60 to barrel nuts 71, each barrel nut 71 with bolt 80 and head 81, with washer 82 and spacer 83, are rotatably mounted within a suitable opening of and from the top side 22*t*, 23*t* of each jaw 22, 23. The bolthead 81 rides along its corresponding ramp 74 of its bar 61 by reason of the greater diameter of washer 82. Spacer 83 provides the spacing required between washer 82 and the top of cylinder 77, in assembly of the invention. Any suitable element which can ride on ramp 74 can be substituted for bolt 80, and its head 81, such as a flanged element, and which continues to connect assembly 60 to barrel nuts 71.

Figure 8:
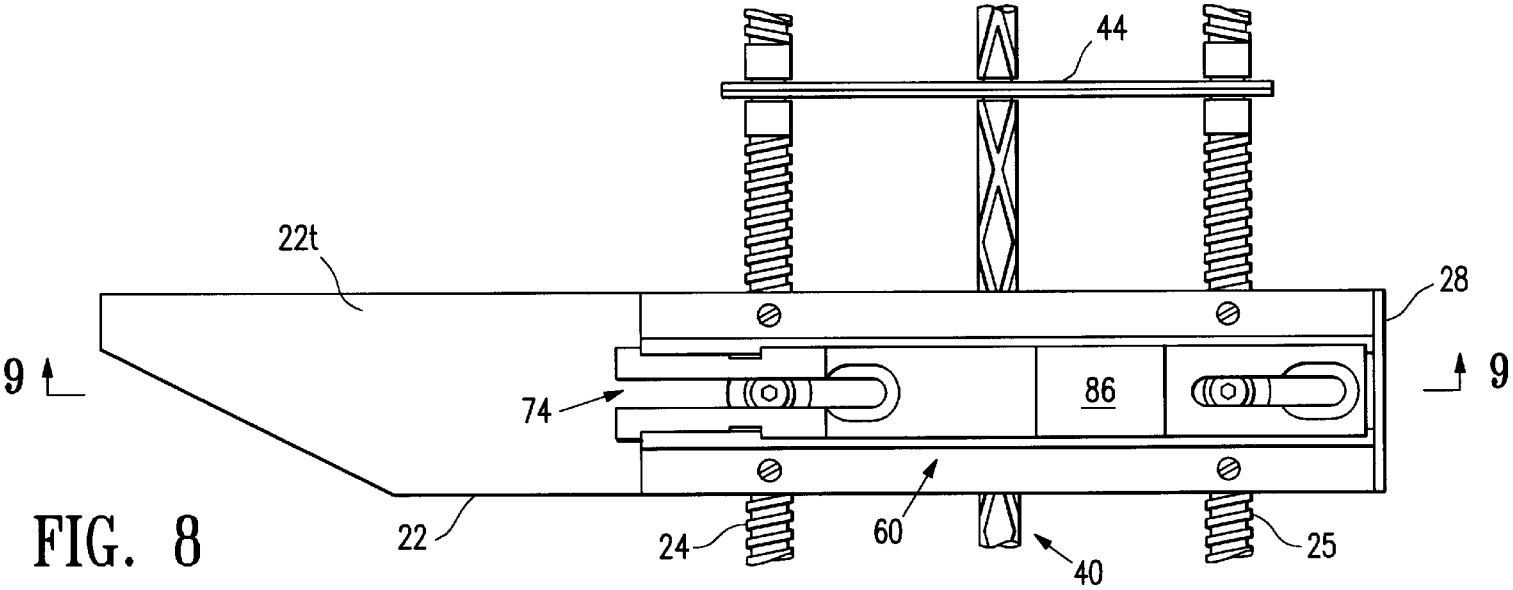
FIG. 8 is a view like that of FIG. 4, however, with the sliding assembly in a position to one of the jaws at which there is no engagement of the jaw's threaded rods with the 'quarter-turn' threads of its barrel nuts.
Figure 9:
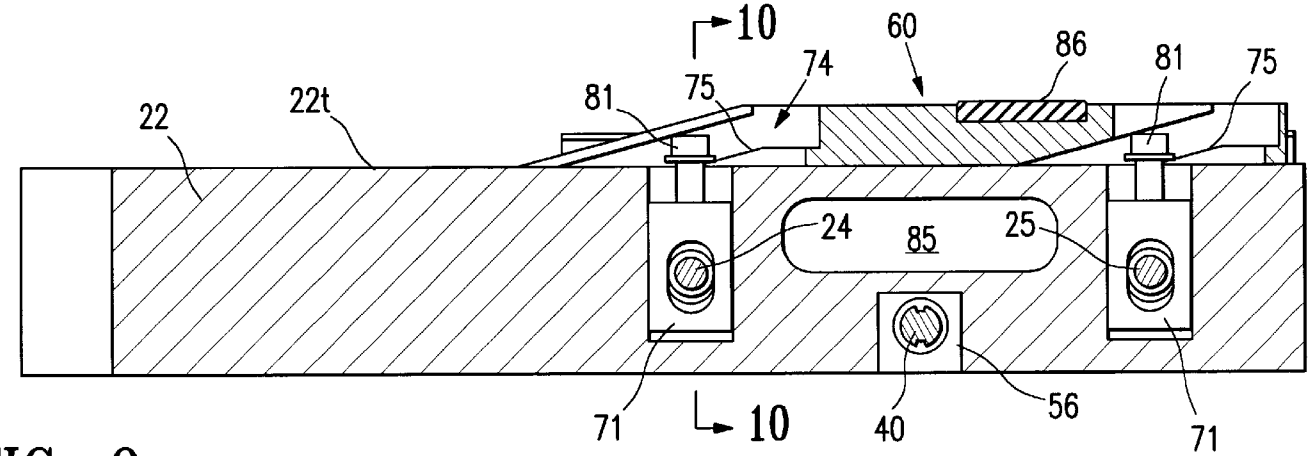
FIG. 9 is a view taken on line 9—9 of FIG. 8, with the sliding assembly in position to one of the jaws at which there is no engagement of the jaw's threaded rods with the 'quarter-turn' threads of its barrel nuts.
Figure 10:
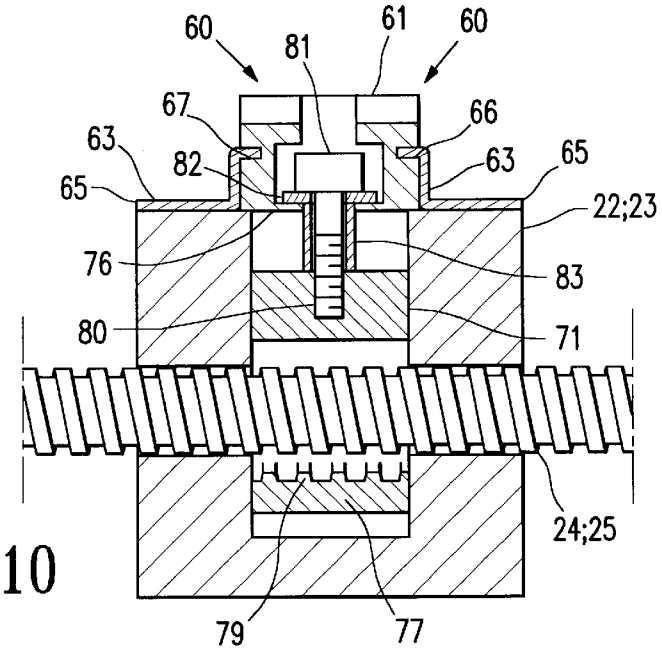
FIG. 10 is a view taken on line 10—10 of FIG. 9, and is like that of FIG. 6, however, with the threads of its rod free of the barrel nut of FIG. 7.

In operation, with jaws 22, 23 in an unlocked mode, FIGS. 8, 9, 10, in relation to their threaded rods, jaws 22, 23 are grasped by fingers (not shown) of the user being inserted into finger grip recesses 85, FIGS. 2, 5, 9, 11 formed in the exterior sidewalls 22*e*, 23*e* of jaws 22, 23, with mechanism 20's rear walls 28, 29 of jaws 22, 23 closest to the user. The jaws freely displace to-and-fro, readily along threaded rods 24, 25, to the extent required to grasp the sizes of pieces (not shown) to be clamped together (for fastening or for other purposes). In such free movement of jaws 22, 23, rod 40 guides equal displacement of the jaws from midpoint 36, by reason of the set 50 of keys in tubular member 54 of cylindrical fitting 56, FIG. 12A riding in its set 41, FIG. 11, of keyways in spiral rod 40 for jaw 22 and of the set 51 of keys in tubular member 55 of cylindrical fitting 57, FIG. 12B, riding in its set 42, FIG. 11, of keyways in spiral rod 40 for jaw 23. Upon reaching the point for jaws 22, 23 to lock onto their corresponding threaded rods 24,25, the thumbs (not shown) of the user push or advance both assemblies 60 on the top sides 22*t*, 23*t* of jaws 22, 23, preferably with thumb grip material 86 suitably affixed thereto, as illustrated in FIGS. 1, 5, 8, and 9. As assemblies 60 are pushed or advanced from their positions illustrated in FIGS. 8 and 9, along their corresponding top sides 22*t*, 23*t*, to their positions illustrated in FIGS. 1, 4, 5, each bolt head 81 and washer 82 ride up on their corresponding shoulders 75 of their corresponding slotted ramps 74 until reaching the ramp's top at its closed end. The barrel nuts 71 in jaws 22, 23 and threaded rods 24, 25 are now in engagement as illustrated in FIG. 6, the jaws in locked mode with their threaded rods 24, 25. Handles 32, 33 are turned as necessary to rotate threaded rods 24, 25 to further enhance the grip of jaws 22, 23 on the piece or pieces clamped between them.

Figure 15:
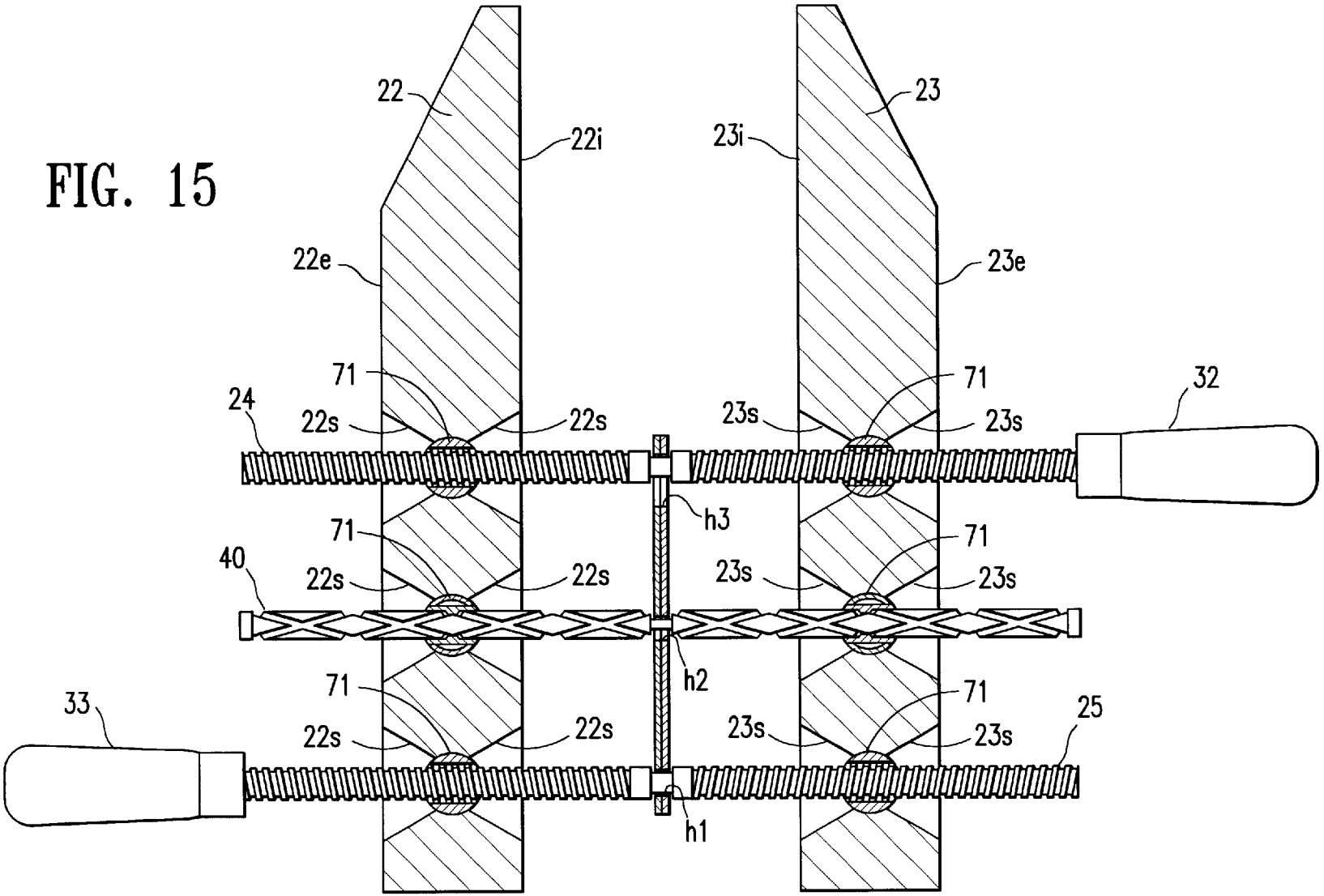
FIG. 15 is a diagrammatic cross-sectional view of the clamp mechanism illustrated in FIG. 1.
Figure 16:
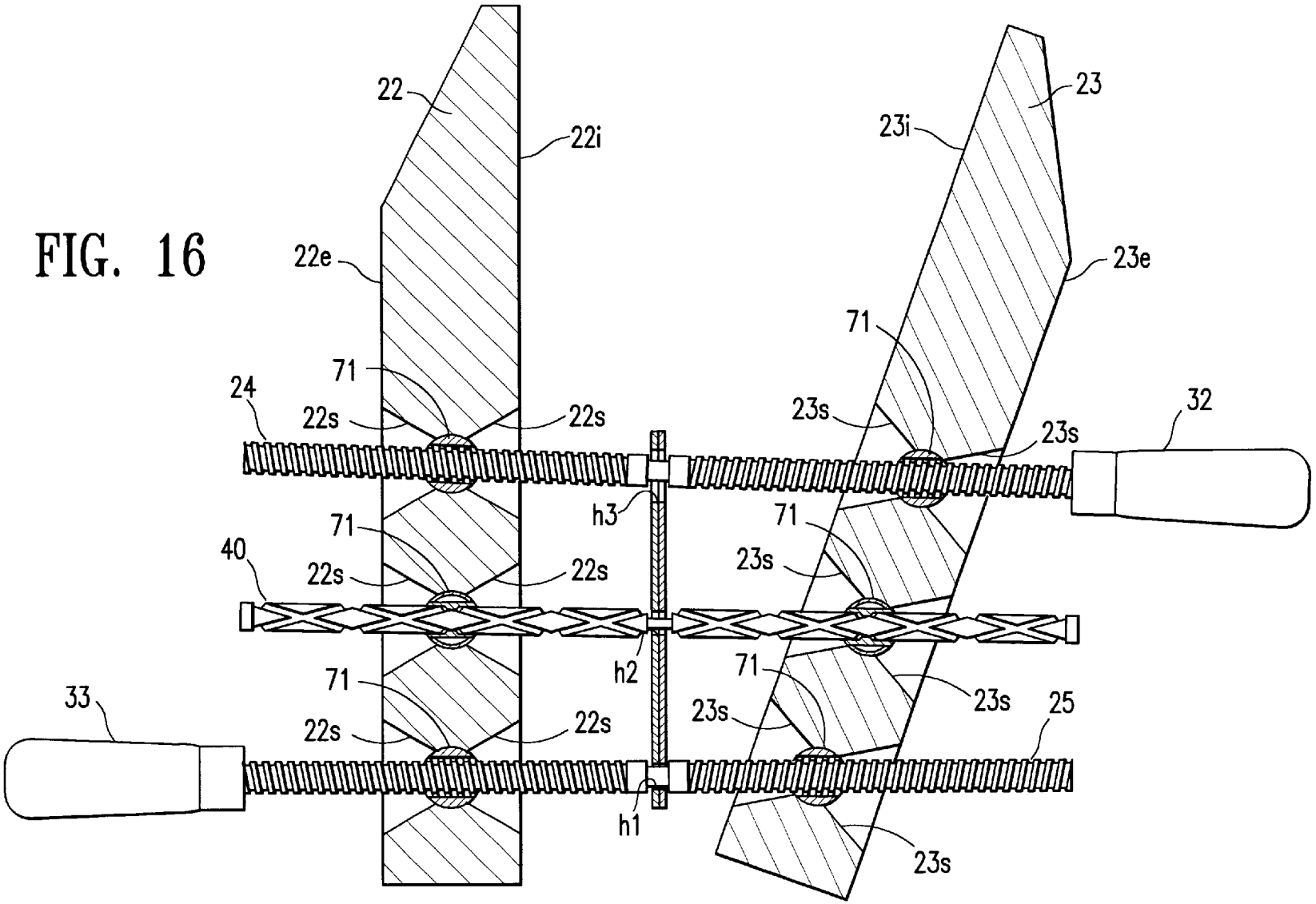
FIG. 16 is a diagrammatic cross-sectional view of the clamp mechanism illustrated in FIG. 15, however, with one of the jaws angularly displaced from its perpendicularity with the rods illustrated in FIGS. 15 and 1.

FIGS. 15 and 16 diagrammatically illustrate how a jaw (representing either jaw 22, 23) is swung or angularly rotated in the its general plane of clamp mechanism 20, to clamp pieces the walls of which to be gripped are not parallel to a perpendicular setting of clamp mechanism 20 as illustrated by the positions of jawsides 22*i*, 23*i* shown in FIG. 1. In FIG. 15, duplicating the parallel positions of the jawsides 22*i*, 23*i* of FIG. 1, plate member 44 is shown with its holes h1, h2, and h3 encompassing their corresponding rods when the pair of jaws are parallel to one another. FIG. 16 illustrates the jaw 23 maneuvered so that its jawside 23*i* is not parallel to jawside 22*i*. With the condition of an unlocked mode for clamp mechanism 20, jaw 23 is free in an angular or swinging motion by reason of rotation of the barrel nuts 71 within jaw 23. With the rotation of barrel nuts 71 in jaw 23, concurrently rod 25 and rod 40 at their mid-point 36 have laterally moved from their positions adjacent their rims 48 to a more central position in their elongated holes h2, h3. Conical-like slots 22*s*, 23*s* are formed in opposing sidewalls 22*i*, 22*e* and 23*i*, 23*e* of both jaws 22, 23, respectively, radiating from their barrel nuts 71 so that each jaw 22, 23 is capable of swinging about or angularly moved in the general plane of clamp mechanism 20 to accommodate a setting for the sidewalls 22*i* and/or 23*i* of the jaws 22, 23 about pieces to be clamped together.

Figure 19:
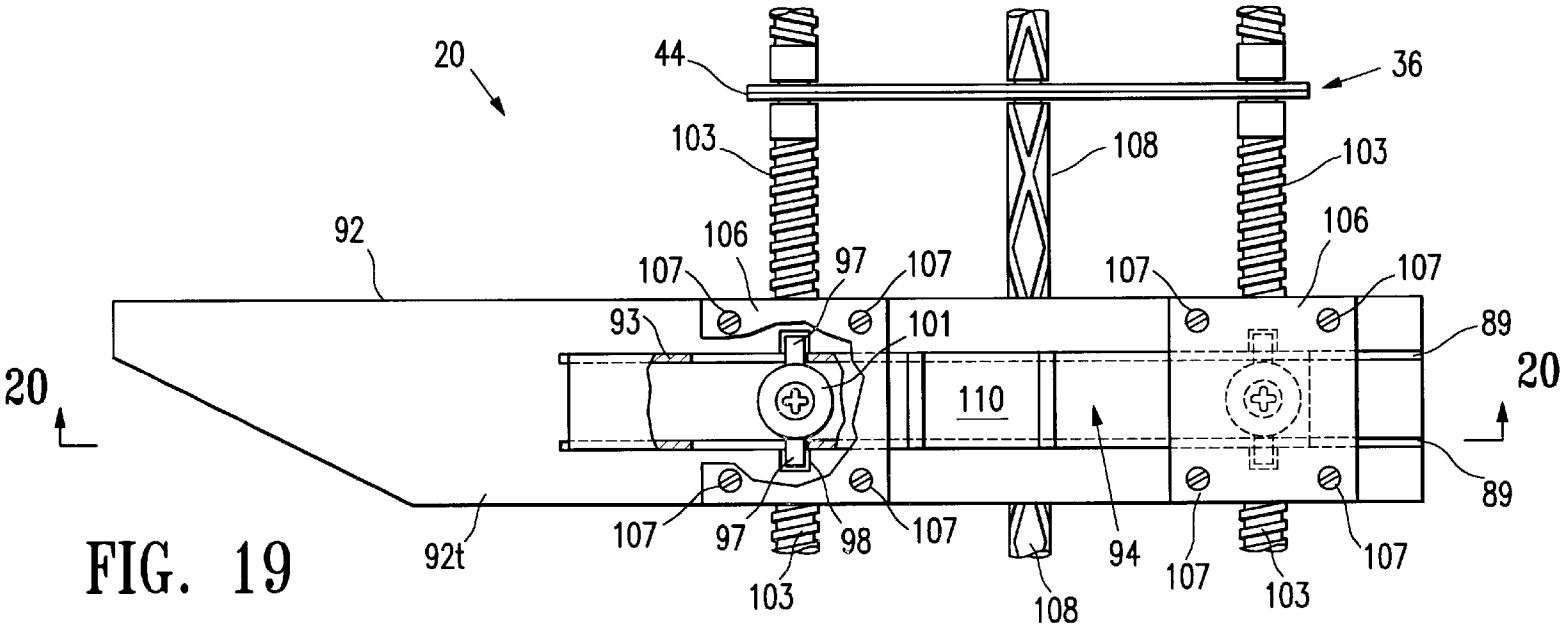
FIG. 19 is a top or front view, partly broken away, of another embodiment of this invention.
Figure 20:
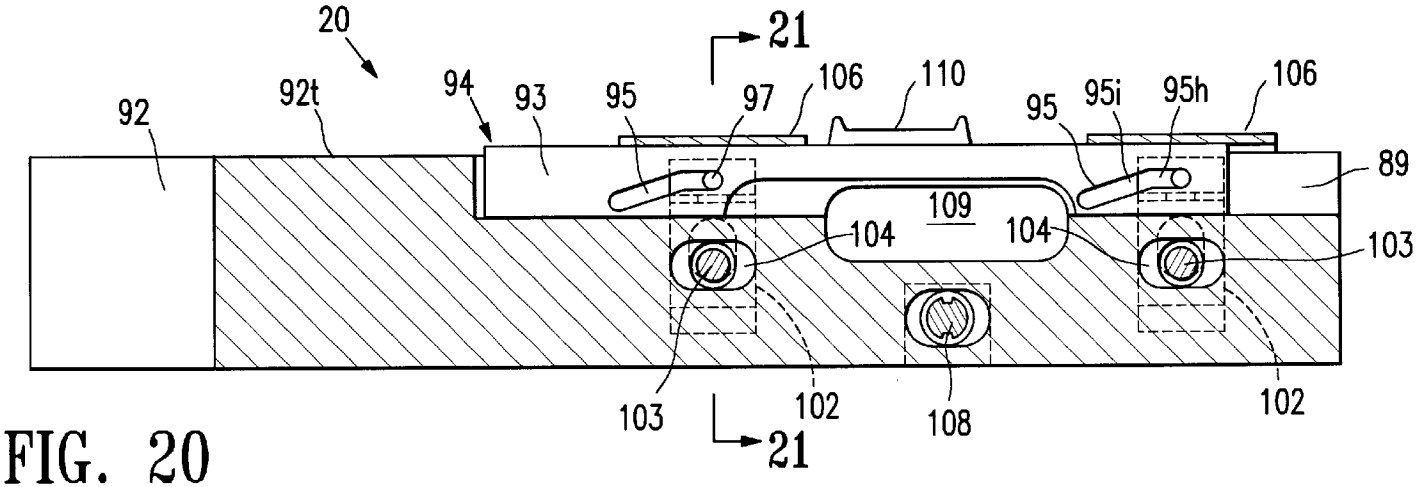
FIG. 20 is a view taken on line 20—20 of FIG. 19, showing a sliding assembly in a position on one of the jaw at which there is engagement of the jaw's threaded rods with the 'quarter-turn' threads of its barrel nuts.
Figure 22:
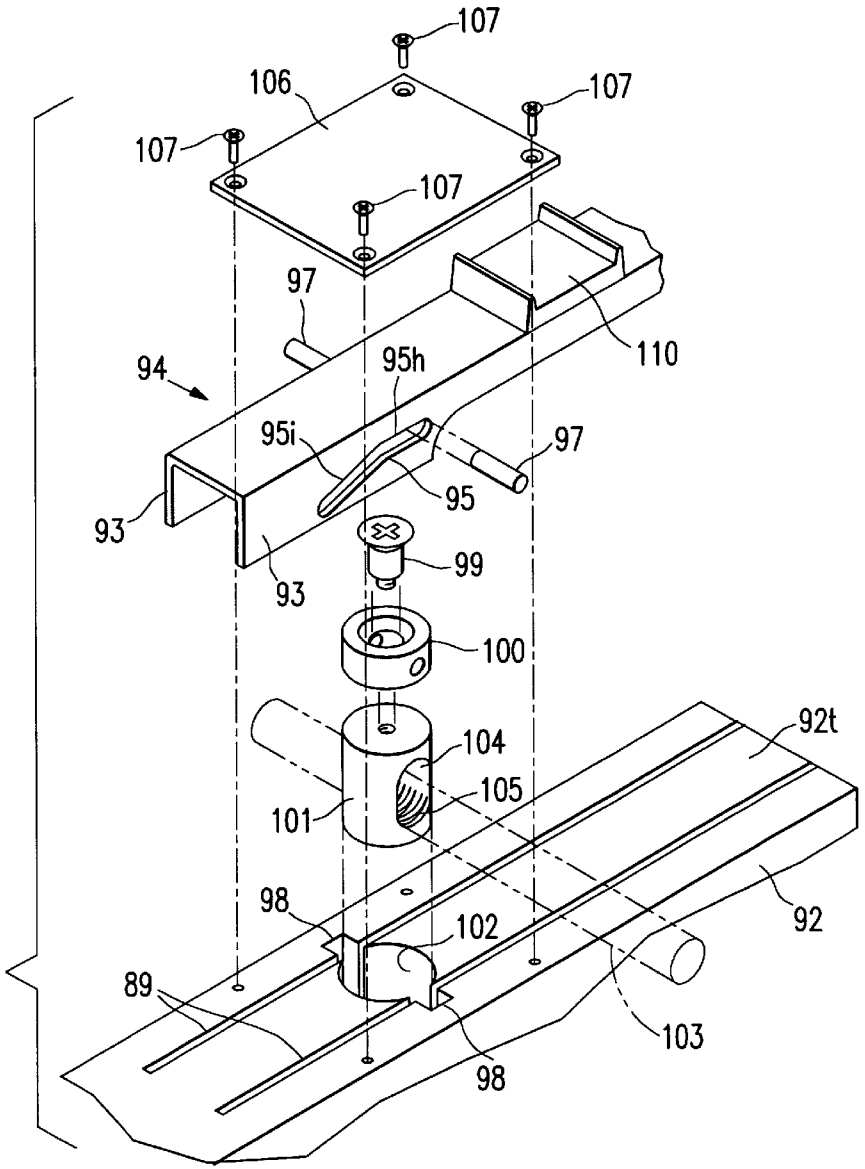
FIG. 22 is an exploded fragmentary view of the embodiment illustrated in FIG. 19.
Figure 21:
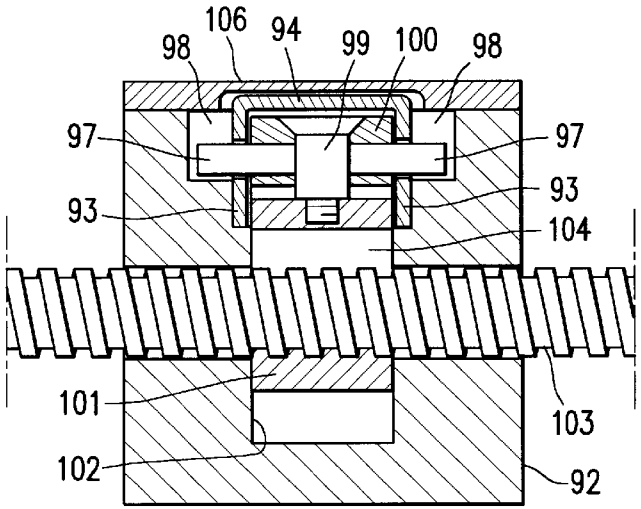
FIG. 21 is a view taken on line 21—21 of FIG. 20.

An alternate embodiment of the invention is illustrated in FIGS. 19–24. A pair of slideways 89 are formed in the top wall 92*t* of each jaw 92 and into and along which a pair of side rails 93 of a sliding member 94 seat and are guided. Congruous slots 95, FIGS. 20, 21, having a horizontally-oriented portion 95*h* and an inclined portion 95*i* in each, is formed in side rails 93. Pins 97 extend through in their locations in hollowed-out openings 98 exteriorly of slideways 89 in jaw 92, FIGS. 21, 22, with their inner ends abutting a bolt or screw 99 projecting through a spacer 100 and which is secured to each barrel nut 101 situated in its cylindrical opening 102 in jaw 92. Two pins rather than one pin extending between the two hollow-out openings 98 provides for better mobility of barrel nuts 101. Each threaded rod 103 (FIG. 19 representing both rods in a clamp mechanism 20) extends through an elongated bore 104 having 'quarter-turn' threads 105 in barrel nut 101 in its cylindrical bore 102, FIG. 22, in the same manner as in the earlier described embodiment. A covering plate 106 is suitably secured by screws 107, FIG. 22, to the top 92*t* of jaw 92, generally over the location of each barrel nut 101 in its jaw 92, to provide for the retention of sliding member 94 in its slideways 89 in the operation of the invention.

Figure 23:
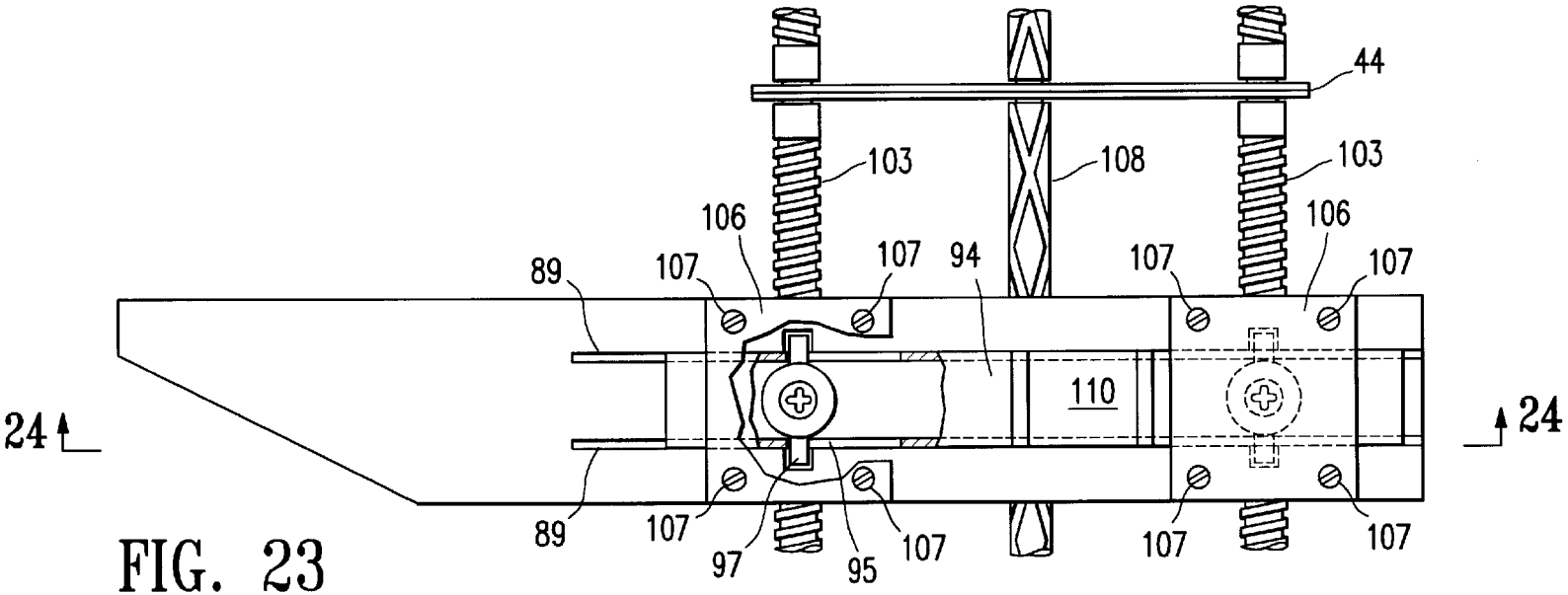
FIG. 23 is a view like that of FIG. 19, however, with the sliding assembly in an alternate position to one of the jaws at which there is no engagement of the jaw's threaded rods with the 'quarter-turn' threads of its barrel nuts.
Figure 24:
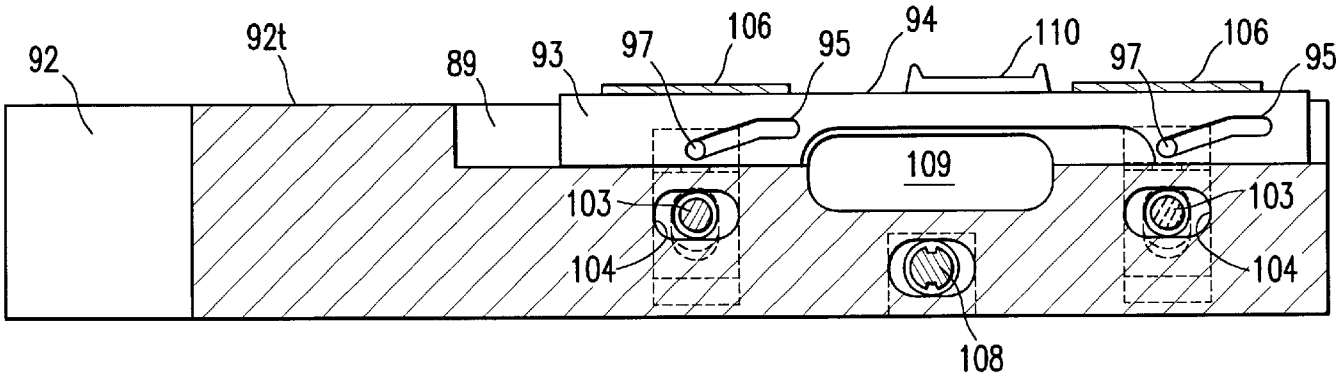
FIG. 24 is a view taken on line 24—24 of FIG. 23.

In operation, with sliding member 94 in an unlocked mode, FIGS. 23, 24, relative to threaded rods 103, jaws 92 are free to move or translate along threaded rods 103, and a spirally-wound rod 108, in the same manner as described above in regard to the first described embodiment. With a user's fingers gripping recesses 109, FIG. 24, of jaws 92, the user's thumbs (not shown) on thumb-grips 110 on both jaws 92 pushes or advances sliding member 94, so that as sliding member 94 slides along its slideways 89, slots 95 travel along pins 97 and thereby raise or elevate each barrel nut 101 into engagement with its corresponding threaded rods 103 or lower each barrel nut 101 to disengage its 'quarter-turn' threads from rods 103. Spirally-wound rod 108, when included, maintains equal displacement of jaws 92 from midpoint 36 in the same manner as described above in the earlier described embodiment.

Figure 18:
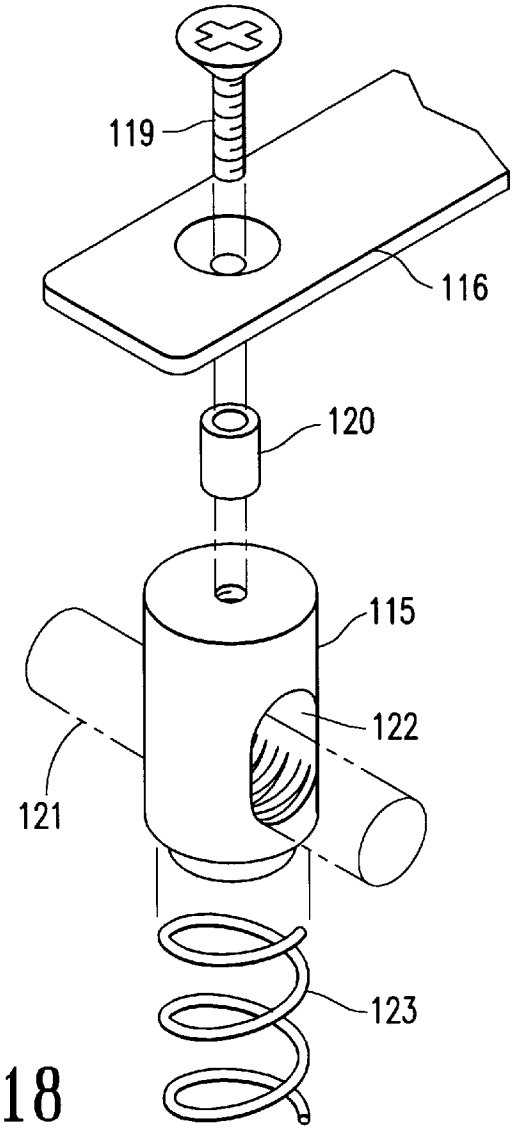
FIG. 18 is a perspective fragmentary exploded diagrammatic view of the handle, screw, spacer, biased spring means, and 'quarter-turn' barrel nut illustrated in FIG. 17.
Figure 17:
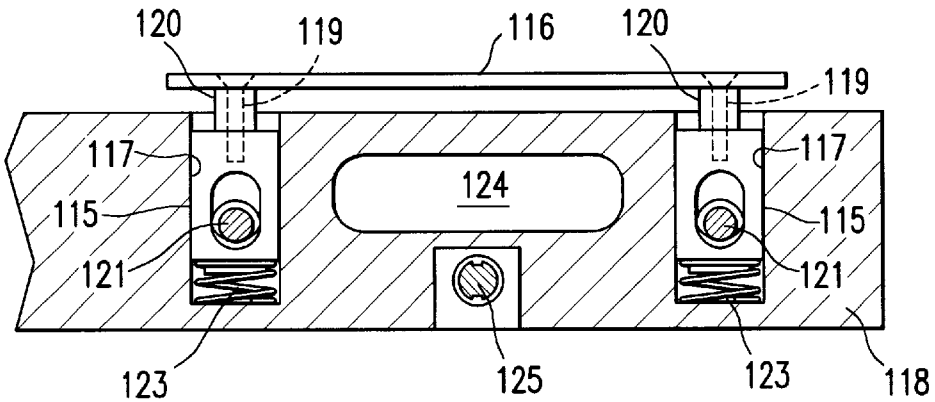
FIG. 17 is a fragmentary cross-sectional view of one of the jaws with a handle or push-plate assembly for disengaging 'quarter-turn' threads in barrel nuts from threads of a threaded rod by biased spring means.

FIGS. 17 and 18 illustrate the utilization of spring-biased barrel nuts 115 in an embodiment of this invention. FIG. 18 illustrates how a handle 116 is connected in fixed manner to the barrel nuts 115 of FIG. 17 and which seat in their respective cylindrical bores 117 within its jaw 118. A pair of threaded screws 119 are mounted to handle 116 and extend through it and through a spacer 120 to connect to barrel nuts 115 through which threaded rods 121 extend in 'quarter-turned' bores 122. A spring 123 seats in the bottom of each cylindrical bore 117. In operation, as fingers of a user grip recesses 124 on the sides of a pair of jaws 118 in a clamp mechanism, the hands' palms (not shown) depress handles 116 against barrel nuts 115, thereby releasing jaws 118 from a locked mode with threaded rods 121 of its clamp mechanism. Each jaw 118 then is freely moveable to-and-fro along the length of their rods 121, being equally displaced from their midpoint by means of a spirally-wound rod 125, in the same manner as described above in the earlier embodiments. Upon releasing handle 116 from the palms, once again jaws 118 are locked to their threaded rods 121 while concurrently displaced equally from the mid-point of the mechanism.

In assembly of clamp mechanism 20, FIG. 1, the aforescribed elements are fabricated in known manner on ssuitable materials. Each cylindrical fitting 56, 57 with their soldered cross-wise keyed tubular members 54, 55 are press fit from the bottom sides into the openings provided in jaws 22, 23, after which third rod 40 with its two sets 41, 42 spirally-wound keyways are keyed to sets 50, 51 of keys in tubular members 54, 55 of the cylindrical fittings 56, 57 in the jaws 22, 23. Barrel nuts 71 with bolts 80, boltheads 81, washers 82 and spacers 83 are inserted into their corresponding openings in the tops of their jaws. Bar 61 is mounted to the top of each jaw, with the shoulders 75 on their ramps 74 engaging the underside of the washers 82. Flanged members 63 then are placed in position to guide and retain sliding bar 61 after which screws 64 secure it to the top of each jaw 22, 23. The handled threaded rods 24, 25 are thrust through both jaws and through the 'quarter-turn' threaded bores of the barrel nuts. The metal pieces 46 of plate member 44 are fitted together about the rods 24, 25, and 40 at the midpoint 36 and securely mounted thereto by screws 47.

In the assembly of the embodiment illustrated in FIGS. 19–24, the barrel nut 99, spacer 101, and bolt 102 are connected together, inserted between the side rails 93, the pins 97 thrust through slots 95 to abut or tend to abut bolt/screw 99. This sub-assembly then is dropped into each jaw 92, with the barrel nut 104 rotatably seated in its cylindrical opening 102, the pins 97 seated in their corresponding openings 98 in jaws 92. The side rails 93 seat in their slideways 89. Each covering plate 106 is then secured to its jaw by screws 107 to retain sliding assembly 94 in place.

In the FIG. 17–18 embodiment, cylindrical openings 117 in the jaws 118 are provided for each barrel nut 115 and its associated spring 123. Handle 116 is connected to each pair of barrel nuts 115 in its jaw 118, after which, by depressing handle 116, threaded rods 121 are inserted through the bores 122 of the barrel nuts 115 in each pair of jaws.

Suitable materials, such as wood, metal, plastic, glass reinforced nylon, etc., form the aforescribed elements, the particular material suitable and applicable for each of such elements, with their farications, being well known in the art.

Various modifications, changes, and variations may be made without departing from the spirit and scope of the invention. The descriptive term 'quarter-turn' for the threads in the bores of the barrel nuts is not limited to a 90-degree threading in the bores abut includes a threading for a reasonable number of degrees in the threads by which engagements thereof to the jaws assures the locking of the jaws to the threaded rods. The inventive concept of clamp mechanism 20 and its illustrated embodiments embraces design of sliding assemblies within the bodies of the jaws 22, 23 themselves. The sliding assemblies are applicable to conventional clamp mechanisms which do not necessarily include the third rod 40. The senses of the threaded rods are not limited to two (2) as but only one (1) sense is applicable to the operation of the invention as well. Only one keyway to each side of plate member 44 need be formed in rod 40, such keyway cooperating with the keys in the cylindrical fitting for the jaw to its particular side of the plate member. The distance to the center plate mounting from the handles 32, 33 is not necessarily limited to being equal for both threaded rods 24, 25. A flanged member can be substituted for washer 82 so that bolt 80 rides along shoulders 75. The pins 97 can be but one pin projecting throughout siderails 93 into the openings 98, however, less mobility for the barrel nuts would occur.

Industrial Applicability

The apparatus is most useful in wood-working applications, however, the mechanism itself is not limited to fastening merely wooden components together, and is suitable for application in other classes of art as well.

I claim:

1. A clamp mechanism including a pair of jaws and threaded rod members extending through said jaws, barrel nut means rotatably mounted in each of said jaws, said barrel nut means including body formations forming bores and on which 'quarter-turn' means are formed in the bores, and slidable assembly means mounted to said jaws for actuating said barrel nut means whereby said 'quarter-turn' means engage and disengage said rod members thereby locking and unlocking said threaded rod members.

2. The clamp mechanism of claim 1 wherein said slidable assembly means comprises ramp means by which said 'quarter-turn' means engages and disengages from said threaded rod members.

3. The clamp mechanism of claim 2 wherein said slidable assembly means includes members having bases slidably mounted along said jaws, said ramp means included in said slidably mounted members and by actuation of which said 'quarter-turn' means engages and disengages from said threaded rod members.

4. The clamp mechanism of claim 3 wherein said ramp means comprises slotted means extending from said bases upwardly through said slidably mounted members, and means for connecting said barrel nut means to said slotted means.

5. The clamp mechanism of claim 4 wherein said connecting means comprises a bolt-and-washer arrangement extending through said slotted means and fixed to said barrel nut means.

6. The clamp mechanism of claim 1 or claim 2 or claim 3 or claim 4 or claim 5 including means for maintaining equality of opening and closing from a midpoint for said pair of jaws from and to one another along said threaded rod members.

7. The clamp mechanism of claim 6 wherein said maintaining means comprises spirally-wound rod means offset from the plane of and extending through said pair of jaws in the same directions as said threaded rod members, and means for joining together said rod means and threaded rod members at the mid-point.

8. The clamp mechanism of claim 7 wherein said joining means comprises rigid means mounted at the mid-point for said threaded rod members and rod means, said threaded rod members and rod means extending through and to each side of said rigid means, the points of said threaded rod members and rod means at said rigid means remaining the same in operation of said clamp mechanism.

9. The clamp mechanism of claim 8 including radiating conically-configured slots in said jaws, said rigid means including hole means about said threaded rod members and rod means whereby angular motion for either or both of said jaws is effected through said conical-like slots in the unlocked mode of said jaws to said threaded rod members by rotation of the barrel nuts in said barrel nut means.

10. The clamp mechanism of claim 9 wherein said threaded rod members comprise a pair of threaded rods, each of said threaded rods having a sense of threads different than the other and extending in opposing directions from the mid-point.

11. The clamp mechanism of claim 1 wherein said pair of jaws include slideways, said sliding assembly means comprising sliding members having siderails seated in said slideways, slot means formed in said siderails, pin means seated in hollow openings in each of said jaws exteriorly of its slideways, said pin means operatively connected to said slot means, whereby the sliding of said sliding assembly along said slot means engages and disengages said 'quarter-turn' means with said threaded rod members.

12. The clamp mechanism of claim 11 including cover means for retaining said sliding members to said pair of jaws.

13. The clamp mechanism of claim 11 or claim 12 including means for maintaining equality of opening and closing from a midpoint for said pair of jaws from and to one another along said threaded rod members.

14. The clamp mechanism of claim 13 wherein said maintaining means comprises spirally-wound rod means offset from the plane of and extending through said pair of jaws in the same directions as said threaded rod members, and means for joining together said rod means and threaded rod members at the mid-point.

15. The clamp mechanism of claim 14 wherein said joining means comprises rigid means mounted at the mid-point for said threaded rod members and rod means, said threaded rod members and rod means extending through and to each side of said rigid means, the points of said threaded rod members and rod means at said rigid means remaining the same in operation of the invention.

16. The claim mechanism of claim 15 including radiating conically-configured slot in said jaws, said rigid means including hole means about said threaded rod members and rod means whereby angular motion for either or both of said jaws is effected through said conical-like slots in the unlocked mode of said jaws to said threaded rod members by rotation of the barrel nuts in said barrel nut means.

17. The clamp mechanism of claim 16 wherein said threaded rod members comprise a pair of threaded rods, each of said threaded rods having a sense of threads different than the other and extending in opposing directions from the mid-point.

18. The clamp mechanism of claim 1 including means for maintaining equality of opening and closing from a midpoint for said pair of jaws from and to one another along said threaded rod members, and means on said maintaining means for preventing said jaws from exiting from said mechanism.

19. The clamp mechanism of claim 18 wherein said preventing means is at least one nut secured to an end of said maintaining means.

20. A clamp mechanism including a pair of jaws and threaded rod members extending through said jaws, said jaws including radiating conically-configured slots, barrel nut means rotatably mounted in each of said jaws, said barrel nut means having barrel nuts and including body formations forming bores and on which 'quarter-turn' means are formed in the bores, means for maintaining equality of opening and closing from a midpoint in said clamp mechanism for said pair of jaws from and to one another along said threaded rod members, and means for depressing said barrel nut means fixed to said barrel nut means whereby said jaws disengage from said threaded rod members upon depressing said depressing means and engage said threaded rod members upon releasing said depressing means..

21. The clamp mechanism of claim 20 wherein said depressing means comprises a depressible handle means, said barrel nut means including spring means below said barrel nuts that are rotatably mounted in said jaws and against which the depressing action of said handle means disengages said jaws from said threaded rod members.

22. The clamp mechanism of claim 20 wherein said maintaining means comprises spirally-wound rod means offset from the plane of and extending through said pair of jaws in the same directions as said threaded rod members, and means for joining together said rod means and threaded rod members at the mid-point.

23. The clamp mechanism of claim 22 wherein said joining means comprises rigid means mounted at the mid-point for said threaded rod members and rod means, said threaded rod members and rod means extending through and to each side of said rigid means, the points of said threaded rod members and rod means at said rigid means remaining the same in operation of said clamp mechanism.

24. The claim mechanism of claim 23 including radiating conically-configured slot in said jaws, said rigid means including hole means about said threaded rod members and rod means whereby angular motion for either or both of said jaws is effected through said conical-like slots in the unlocked mode of said jaws to said threaded rod members by rotation of the barrel nuts in said barrel nut means.

25. The clamp mechanism of claim 24 wherein said threaded rod members comprise a pair of threaded rods, each of said threaded rods having a sense of threads different than the other and extending in opposing directions from such mid-point.

26. The clamp mechanism of claim 20 wherein said pair of jaws include slideways, said assembly means comprising sliding members having siderails seated in said slideways, slot means formed in said siderails, pin means seated in hollow openings in each of said jaws exteriorly of its slideways, said pin means operatively connected to said slot means, whereby the sliding of said assembly along said slot means engages and disengages said 'quarter-turn' means with said threaded rod members.

27. A clamp mechanism comprising a pair of jaws and threaded rod members extending through said jaws, rotatably mounted means in each of said jaws, and slidable assembly means mounted to said jaws for advancing and retracting said rotatably mounted means thereby respectively locking and unlocking at least one of said threaded rod members to and from at least one of said pair of jaws.

28. The clamp mechanism of claim 27 wherein said rotatably mounted means comprises barrel nut means in each of said jaws, said barrel nut means including body formations forming bores and on which 'quarter-turn' means are formed in the bores, said slidable assembly means when activated respectively advancing and retracting said barrel nut means to and from said threaded rod members.

29. The clamp mechanism of claim 28 including means for maintaining equality of opening and closing from a midpoint for said pair of jaws from and to one another along said threaded rod members.

30. The clamp mechanism of claim 29 wherein said maintaining means comprises spirally-wound rod means offset from the plane of and extending through said pair of jaws in the same directions as said threaded rod members, and means for joining together said rod means and threaded rod members at such mid-point.

31. The clamp mechanism of claim 30 wherein said joining means comprises rigid means mounted at such mid-point for said threaded rod members and said rod means, said threaded rod members and rod means extending through and to each side of said rigid means, the points of said threaded rod members and rod means at said rigid means remaining the same in operation of the invention.

32. The claim mechanism of claim 31 including radiating conically-configured slot in said jaws, said rigid means including hole means about said threaded rod members and rod means whereby angular motion for either or both of said jaws is effected through said conical-like slots in the unlocked mode of said jaws to said threaded rod members by rotation of the barrel nuts in said barrel nut means.

* * * * *